US006763296B2

(12) United States Patent
Aldrich, III et al.

(10) Patent No.: US 6,763,296 B2
(45) Date of Patent: Jul. 13, 2004

(54) METHOD AND SYSTEM FOR ALTERNATOR LOAD MODELING FOR INTERNAL COMBUSTION ENGINE IDLE SPEED CONTROL

(75) Inventors: William L. Aldrich, III, Davisburg, MI (US); Glenn P. O'Connell, Troy, MI (US); Tony T. Hoang, Warren, MI (US); Michael L. Velliky, Fenton, MI (US)

(73) Assignee: General Motors Corporation, Detroit, MI (US)

( * ) Notice: Subject to any disclaimer, the term of this patent is extended or adjusted under 35 U.S.C. 154(b) by 42 days.

(21) Appl. No.: 10/304,899

(22) Filed: Nov. 26, 2002

(65) Prior Publication Data

US 2004/0102892 A1 May 27, 2004

(51) Int. Cl.[7] ..... F02D 41/16

(52) U.S. Cl. ..... 701/110; 123/339.18; 701/114; 701/115

(58) Field of Search ..... 701/110, 115, 701/101, 102, 114; 123/339.18, 339.19, 339.15, 350

(56) References Cited

U.S. PATENT DOCUMENTS 4,625,281 A * 11/1986 Deutsch ..... 701/101
5,163,399 A * 11/1992 Bolander et al. ..... 123/339.17
5,517,964 A * 5/1996 Chen et al. ..... 123/339.11
5,712,786 A 1/1998 Ueda ..... 364/431.07
5,986,439 A * 11/1999 Pletta et al. ..... 322/59
6,247,446 B1 * 6/2001 Fassler et al. ..... 123/339.22

FOREIGN PATENT DOCUMENTS

JP 7-166943 * 6/1995 ..... F02D/41/16
JP 9-14029 * 1/1997 ..... F02D/41/16

* cited by examiner

*Primary Examiner*—Hieu T. Vo
(74) *Attorney, Agent, or Firm*—Christopher DeVries

(57) ABSTRACT

A method is directed to controlling idle speed for an internal combustion engine. The method provides for monitoring a plurality of vehicle system signal inputs, determining a baseline load control signal based on the vehicle system signal inputs, determining a maximum load control signal based on the vehicle system signal inputs, determining an anticipated load control signal based on the vehicle system signal inputs, determining an idle speed control signal based on the baseline control signal and the anticipated control signal, modifying the idle speed control signal based on vehicle system signal inputs, and controlling the idle speed based on the modified idle speed control signal.

27 Claims, 4 Drawing Sheets

Voltage Generator Load
VG maxload
VG load
VG minload

Vehicle Electrical Load
Vehicle maxload
Vehicle load
Vehicle minload

Filtered and Unfiltered System Voltage
Vmax
Vinst and Vfilt
Vinst
Vfilt
Vmin

Idle Speed Load Compensation
LC max
LCss + LCanticipate
LCss
LC min
t1
t1a
t2
t3

METHOD AND SYSTEM FOR ALTERNATOR LOAD MODELING FOR INTERNAL COMBUSTION ENGINE IDLE SPEED CONTROL

TECHNICAL FIELD

In general, the invention relates to idle speed control of an internal combustion engine. More specifically, the invention relates to a method and system for alternator load modeling that provides stability within a dynamic electrical generation system during idle operations.

BACKGROUND OF THE INVENTION

Internal combustion engines include, among many others, systems for controlling idle speed. Such control impacts many aspects of vehicle operation including fuel efficiency, engine functionality, and the like. For example, fuel efficiency may be maximized when a vehicle operates with a lower idle speed. However, engine functionality may be impaired if idle speed reaches too low of a value due to unavailable torque. Additionally, the lower the engine idle speed, the greater the impact various loadings have on the engine.

A dynamic electrical generation system, also referred to as an alternator, frequently exerts variable loading based on electrical generation power requirements. For example, a mobile vehicle operator may engage power windows, rear defogger, multiple A/C blower settings, cooling fan, and the like. All represent an additional load on the internal combustion engine and the concomitant variations in idle speed. In the past, such challenges have been met with ideas such as setting idle speed to a value that would sustain an acceptable level under maximum loading conditions. Another strategy is to modify the engine air rate in response to the engine speed variations. Unfortunately, either solution results in excessive engine speed fluctuation as electrical loading is applied and removed from the system.

It would be desirable, therefore, to provide a method and system that would overcome these and other disadvantages.

SUMMARY OF THE INVENTION

The present invention is directed to a system and method for controlling idle speed for an internal combustion engine. The invention provides voltage generator load modeling that anticipates load changes and provides stability within a dynamic electrical generation system during idle operations.

One aspect of the invention provides a method for controlling idle speed for an internal combustion engine by monitoring a plurality of vehicle system signal inputs, determining a baseline load control signal based on the vehicle system signal inputs, determining a maximum load control signal based on the vehicle system signal inputs, determining an anticipated load control signal based on the vehicle system signal inputs, determining an idle speed control signal based on the baseline control signal and the anticipated control signal, modifying the idle speed control signal based on vehicle system signal inputs, and controlling the idle speed based on the modified idle speed control signal.

In accordance with another aspect of the invention, a system for controlling idle speed for an internal combustion engine is provided. The system includes means for monitoring a plurality of vehicle system signal inputs. The system further includes means for means for determining a baseline load control signal based on the vehicle system signal inputs. Means for determining a maximum load control signal based on the vehicle system signal inputs is provided. Means for determining an anticipated load control signal based on the vehicle system signal inputs is also provided. The system further includes means for determining an idle speed control signal based on the baseline control signal and the anticipated control signal. The system additionally includes means for modifying the idle speed control signal based on vehicle system signal inputs and means for controlling the idle speed based on the modified idle speed control signal.

In accordance with yet another aspect of the invention, a computer readable medium storing a computer program includes: computer readable code for receiving a plurality of vehicle system signal inputs; computer readable code for determining a baseline load control signal based on the vehicle system signal inputs; computer readable code for determining a maximum load control signal based on the vehicle system signal inputs; computer readable code for determining an anticipated load control signal based on the vehicle system signal inputs; computer readable code for determining an idle speed control signal based on the baseline control signal and the anticipated control signal; computer readable code for modifying the idle speed control signal based on vehicle system signal inputs; and computer readable code for controlling the idle speed based on the modified idle speed control signal.

The foregoing and other features and advantages of the invention will become further apparent from the following detailed description of the presently preferred embodiment, read in conjunction with the accompanying drawings. The detailed description and drawings are merely illustrative of the invention rather than limiting, the scope of the invention being defined by the appended claims and equivalents thereof.

DESCRIPTION OF THE PREFERRED EMBODIMENT

Throughout the specification, and in the claims, the term "connected" means a direct electrical connection between the things that are connected, without any intermediate devices. The term "coupled" means either a direct electrical connection between the things that are connected, or an indirect connection through one or more passive or active intermediary devices. The term "circuit" means either a single component or a multiplicity of components, either active or passive, that are coupled together to provide a desired function.

The present invention relates to idle speed control of an internal combustion engine and, more particularly, to a method and system for modeling the load requirements for a mechanically coupled voltage generator during dynamic electrical generation load requirements. The invention provides idle speed compensation for steady state voltage generator load also referred to as baseline load compensation.

Additionally, the invention anticipates and compensates for increased voltage generator loads referred to as dynamic or anticipatory load compensation. Anticipation of increased voltage generator loads allows the idle control system to more effectively maintain a constant idle speed. Therefore, the present invention allows for determining baseline and dynamic control signals utilizing monitored system inputs, determining a control signal based on the monitored system inputs, and controlling engine idle speed utilizing the determined control signal. The present invention may be implemented with many applications including mobile vehicles, stationary generation devices, and the like.

Illustrative Operating Environment

Figure 1:
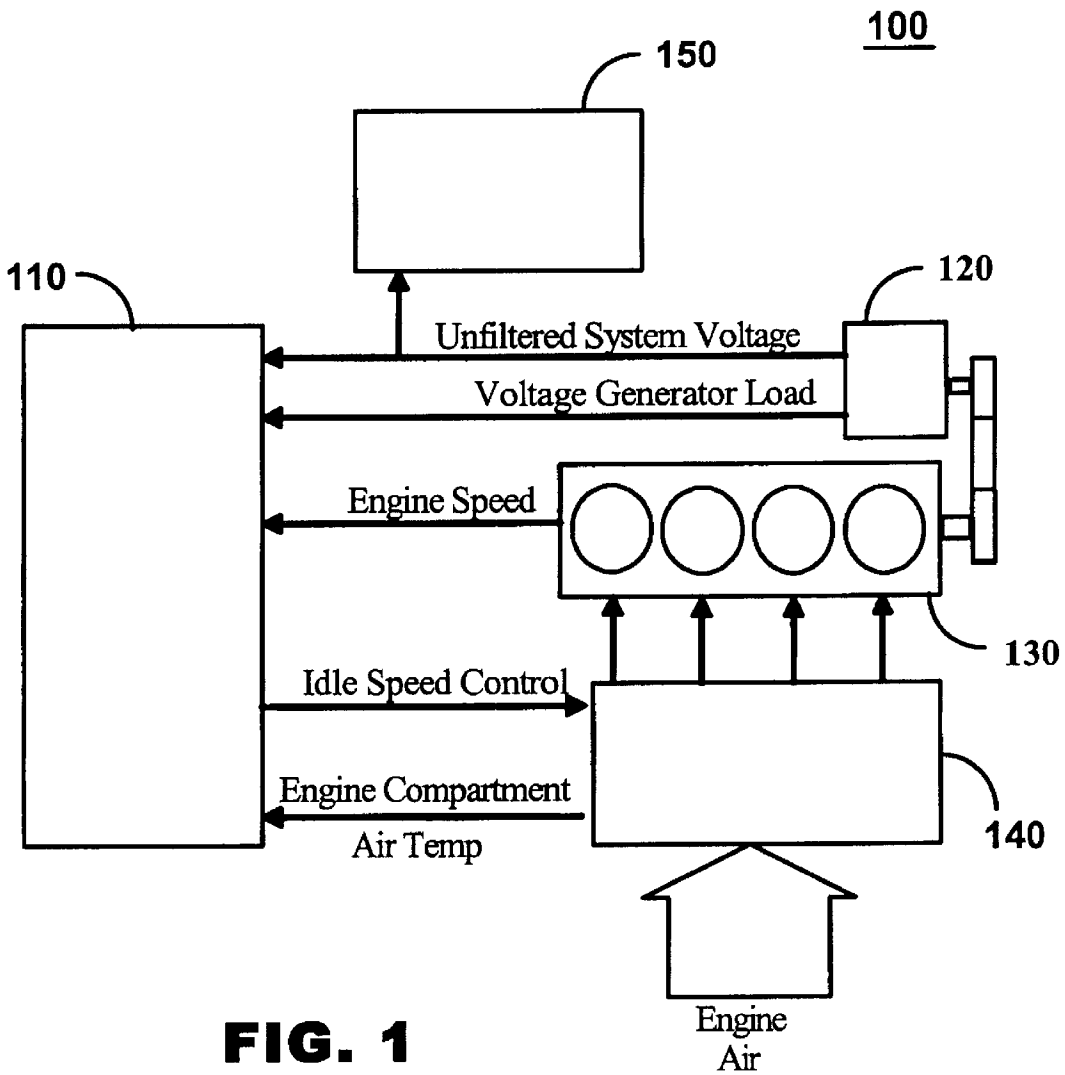
FIG. 1 is a block diagram illustrating an operating environment according to an embodiment of the present invention.

FIG. 1 is a block diagram illustrating an example of an operating environment that is in accordance with the present invention. FIG. 1 details an embodiment of a system for operating an idle speed control system, in accordance with the present invention, and may be referred to as a mobile vehicle idle speed control system 100. The mobile vehicle idle speed control system 100 includes an engine control module (ECM) 110, voltage generator 120, internal combustion engine 130, idle speed control module 140, and variable electrical load 150. Voltage generator 120 is mechanically coupled to engine 130. Engine 130 mechanically drives the voltage generator 120 to produce electrical energy to satisfy the electrical requirements of the variable vehicle electrical load 150. Voltage generator 120 provides an unfiltered system voltage output as well as a load signal output. The air input for engine 130 is modulated by the idle speed control module 140.

Engine control module (ECM) 110 is coupled to the voltage generator 120, engine 130, and the idle speed control module 140. ECM 110 further includes one or more coupled inputs providing an engine speed signal, unfiltered system voltage signal, voltage generator load signal, and, if necessary, an engine compartment air temperature signal which represents the ambient air temperature about voltage generator 120. Additionally, ECM 110 further includes one or more outputs providing an idle speed control signal.

In one preferred embodiment, the engine speed signal is implemented as an engine crank angle signal and the system voltage signal is implemented as an unfiltered analog voltage signal. In this preferred embodiment, the voltage generator load signal is implemented as a duty cycle, which is available as a discrete signal, and the engine compartment air temperature signal is implemented as an analog input from a thermistor.

In another embodiment, the engine compartment air temperature signal is implemented as a modeled value based on another available temperature input. In one example, the modeled value based on another available temperature is implemented as a manifold air temperature value. In yet another embodiment, the engine compartment air temperature signal is implemented as a serially transmitted signal.

In another embodiment, the voltage generator load signal is implemented as an alternator load percentage signal. In one example, the voltage generator load signal is implemented as an alternator's f-terminal duty cycle and available as a discrete signal. In another example, the voltage generator load percentage signal is implemented serially.

Engine control module (ECM) 110 is a control device designed to monitor and receive data from various sources, process the received data, and transmit a control signal. In one embodiment, ECM 110 includes hardware and software necessary to implement idle control via an idle air control (IAC) solenoid device. In another embodiment, ECM 110 includes hardware and software necessary to implement idle control via electronic throttle control (ETC). In another embodiment, ECM 110 has the software necessary to calculate a filtered ignition voltage signal based on the unfiltered analog voltage. The filter rate for the filtered voltage signal is chosen such that it matches the rate at which voltage generator 120 increases its power generation. In an example, ECM 110 is implemented as a central processing unit (CPU) and includes accompanying devices, such as PROMs, and software programming enabling the CPU to conduct operations. Additionally, ECM 110 includes a database having a matrix defining a value of idle speed compensation required for all values of voltage generator load for any given engine speed.

Voltage generator 120 is a self-regulating generator designed to monitor the system voltage and vary its power generation rate so as to maintain a constant system voltage. Voltage generator 120 will increase its power generation rate in a predictable manner in response to increased electrical demand. The rate at which voltage generator 120 increases it power generation rate in response to a voltage below its regulation point is a constant and is specified by a manufacturer. In an example, voltage generator 120 may increase it power generation rate at 25%/second. Consequently, for this example, it would require four seconds for voltage generator 120 to transition from 0% load to 100% load.

Voltage generator 120 possesses a maximum power generation value to meet system needs. In an example, the maximum power generation value is a predetermined value and is determined by the manufacturer. The maximum power generation value is a function of its pulley's rotational speed and therefore, for the system described by FIG. 1, the maximum power generation capability is a function of engine speed. Additionally, this maximum power generation value may be derated as a function of the ambient air temperature of the voltage generator. Voltage generator 120 produces a signal that reflects the percentage of maximum power generation rate that its internal regulator is commanding, and is referred to as the voltage generator load signal. In one embodiment, voltage generator 120 is implemented as an alternator or any such other device as is known in the art.

Engine 130 is an internal combustion engine as known in the art. In one embodiment, engine 130 may include an engine air intake allowing idle control via an idle air control (IAC) controller. In an example, engine 130 receives air from the engine air input at a rate based on an input from the idle speed control module 140. In another embodiment, engine 130 may include a throttle control assembly allowing idle control via an electronic throttle control (ETC) controller.

Idle speed control module 140 is a control device that affects idle speed of engine 130 based on the idle speed control signal received from engine control module (ECM) 110. In one embodiment, idle speed control module 140 is implemented as an idle air control (IAC) controller, as known in the art. In another embodiment, idle speed control module 140 is implemented as an electronic throttle control (ETC) controller, as known in the art.

In operation and detailed in FIG. 2 below, engine control module (ECM) 110 receives signal inputs and generates a control signal output. The idle speed control module 140 receives the idle speed control signal and implements control of idle speed of engine 130.

Exemplary Idle Speed Control

Figure 2:
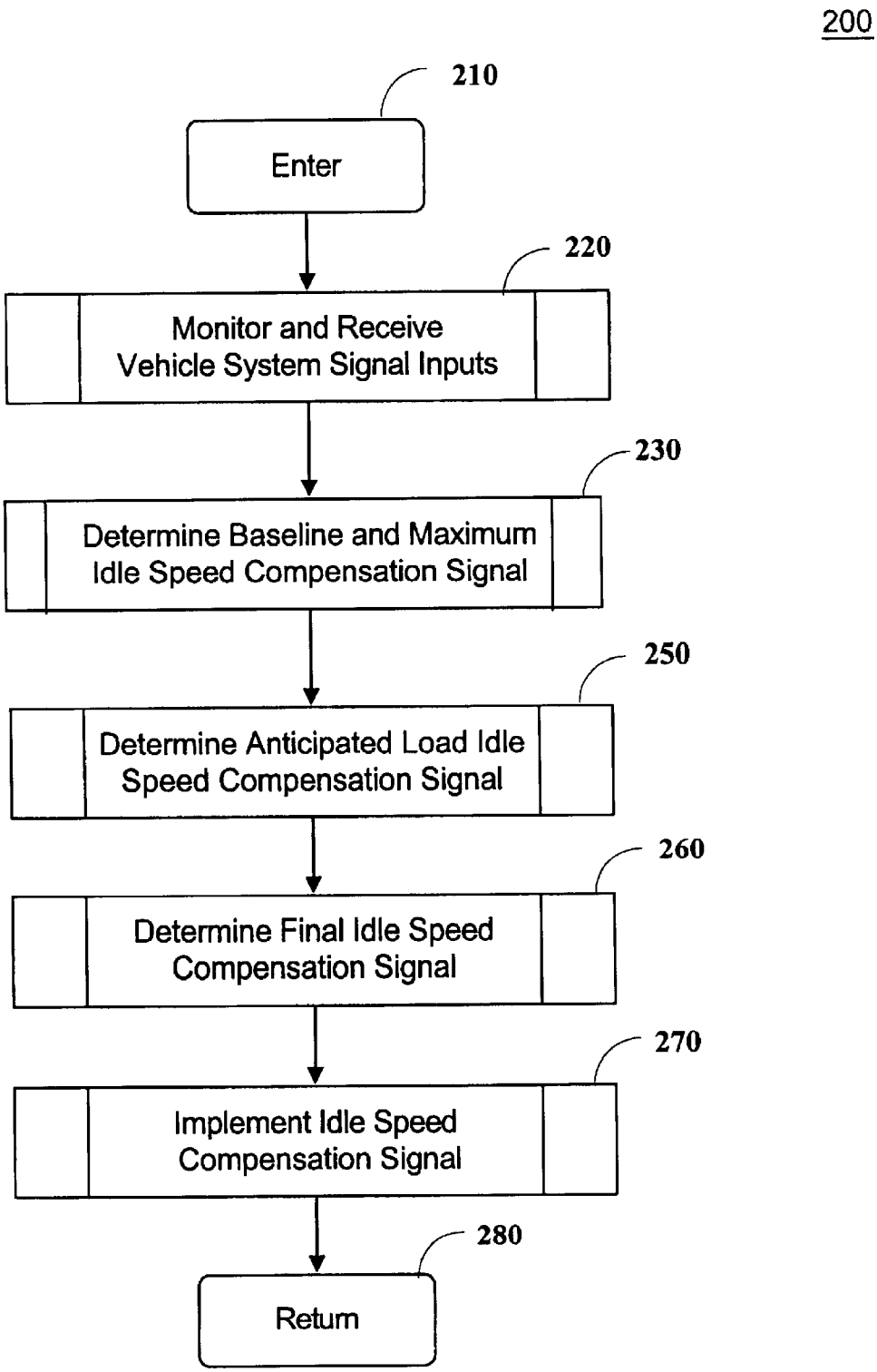
FIG. 2 is a flow diagram depicting an exemplary embodiment of code on a computer readable medium in accordance with the present invention.

FIG. 2 is a flow diagram depicting an exemplary embodiment of code on a computer readable medium in accordance with the present invention. FIG. 2 details an embodiment of a method 200 for operating an idle speed control system, in accordance with the present invention. Method 200 may utilize one or more systems detailed in FIG. 1 above.

Method 200 begins at block 210, which is processed at a periodic rate fast enough to ensure that changing electrical load requirements are identified in a timely manner. Also, the periodic rate must be fast enough to implement the desired idle speed control correction before large engine speed fluctuation occurs. For example, it is desirable to maintain a steady idle speed for a mobile vehicle's internal combustion engine having a voltage control system including a varying load that the engine idle speed control system must accommodate. The load presented by the voltage generation system changes in an unpredictable manner, in response to system as well as user inputs. Additionally, there is typically some delay associated with implementing an idle speed correction signal and the actual change in engine speed. The method then advances to block 220.

At block 220, method 200 monitors and receives vehicle system signal inputs (VSSIs). Method 200 monitors VSSIs utilizing engine control module (ECM) 110 wherein ECM 110 monitors and receives the VSSIs as detailed in FIG. 1 above. The VSSIs include signal input data indicating engine speed, unfiltered voltage levels, voltage generator loading information, engine compartment air temperature and the like. The method then advances to block 230.

At block 230, the method determines a baseline idle speed control signal and a maximum idle speed control signal based on the VSSIs. In one embodiment and referring to FIG. 1, ECM 110 utilizes the engine speed signal, the voltage generator load signal, and the database to determine a baseline idle speed control signal value, also referred to as a steady state load compensation $LC_{ss}$ value. In another embodiment and again referring to FIG. 1, ECM 110 utilizes the engine speed signal, a voltage generator load signal representing the maximum load attainable, and the database to determine a maximum idle speed control signal value, also referred to as a maximum load compensation $LC_{max}$ value. The $LC_{ss}$ represents the amount of idle compensation required for the existing voltage generator load. The $LC_{max}$ represents the amount of idle compensation that would be required if the voltage generator was operating at maximum capacity. The remaining allowable idle speed compensation is then calculated $LC_{remaining}=LC_{max}-LC_{ss}$. The method advances to block 250.

At block 250 the method determines the anticipated load idle speed compensation signal. Anticipated load is characterized by sharp dips in the unfiltered system voltage. In one embodiment, the anticipated load is calculated in a multi-step process. In this embodiment, one step includes determining the positive difference between a filtered system voltage value $V_{filt}$ and the instantaneous unfiltered system voltage value $V_{inst}$. The resulting calculation $V_{diff}=V_{filt}-V_{inst}$ limits the result to positive values only. In this embodiment, results less than zero will result in $V_{diff}=0$. The magnitude of $V_{diff}$ indicates instantaneous voltage dips or when related to the voltage generation system, the application of an electrical load.

In another step, the anticipated load compensation value is determined based on $V_{diff}$, a constant $K_1$ provided from the database, and $LC_{remaining}$. $K_1$ is chosen such that when multiplied by $V_{diff}$, their product represents a gain in the range of zero to one. Gains greater than one are limited to one. The anticipated load compensation is calculated as $LC_{anticipate}=(K_1*V_{diff})*LC_{remaining}$. Therefore, since the product of $K_1$ and $V_{diff}$ is limited to one, $LC_{anticipate}$ can never be greater than $LC_{remaining}$. The method advances to block 260.

At block 260, the method determines a control signal as a summation of the steady state compensation $LC_{ss}$ and the anticipated compensation $LC_{anticipate}$. The summation is calculated as $LC_{sum}=LC_{ss}+LC_{anticipate}$. In one embodiment, the control signal determination includes modifying the load compensation sum value by a voltage generator derating factor as a function of the engine compartment air temperature $T_{eng_compartment}$. A derating factor $K_{derate}$ is retrieved from the database using $T_{eng_compartment}$ as the input. This is only necessary if the voltage generator device does not include this derating information in its load signal. If derating is not necessary, $K_{derate}$ is set equal to one. Consequently, the calculation for the final load compensation signal is $LC_{final}=LC_{sum}*K_{derate}$. The method then advances to step 270.

At block 270, the method controls idle speed utilizing the control signal $LC_{final}$. In one embodiment, engine control module (ECM) 110 passes the control signal to idle speed control module 140 via the idle speed control output. Idle speed control module 140 implements the control signal and controls the idle speed of engine 130. Method 200 then advances to block 280, where it returns to wait for the next periodic time-base event which will cause method 200 to be re-executed.

FIGS. 3A to 3D illustrate examples of time-based state diagrams for idle operation of an engine to which an idling speed controls method according to the present inventions is applied. FIGS. 3A to 3D include timing marks (t1, t1*a*, t2, and t3) and may utilize one or more systems detailed in FIG. 1 above, and one or more portions of the method detailed in FIG. 2 above.

Figures 3A, 3B, 3C, 3D:
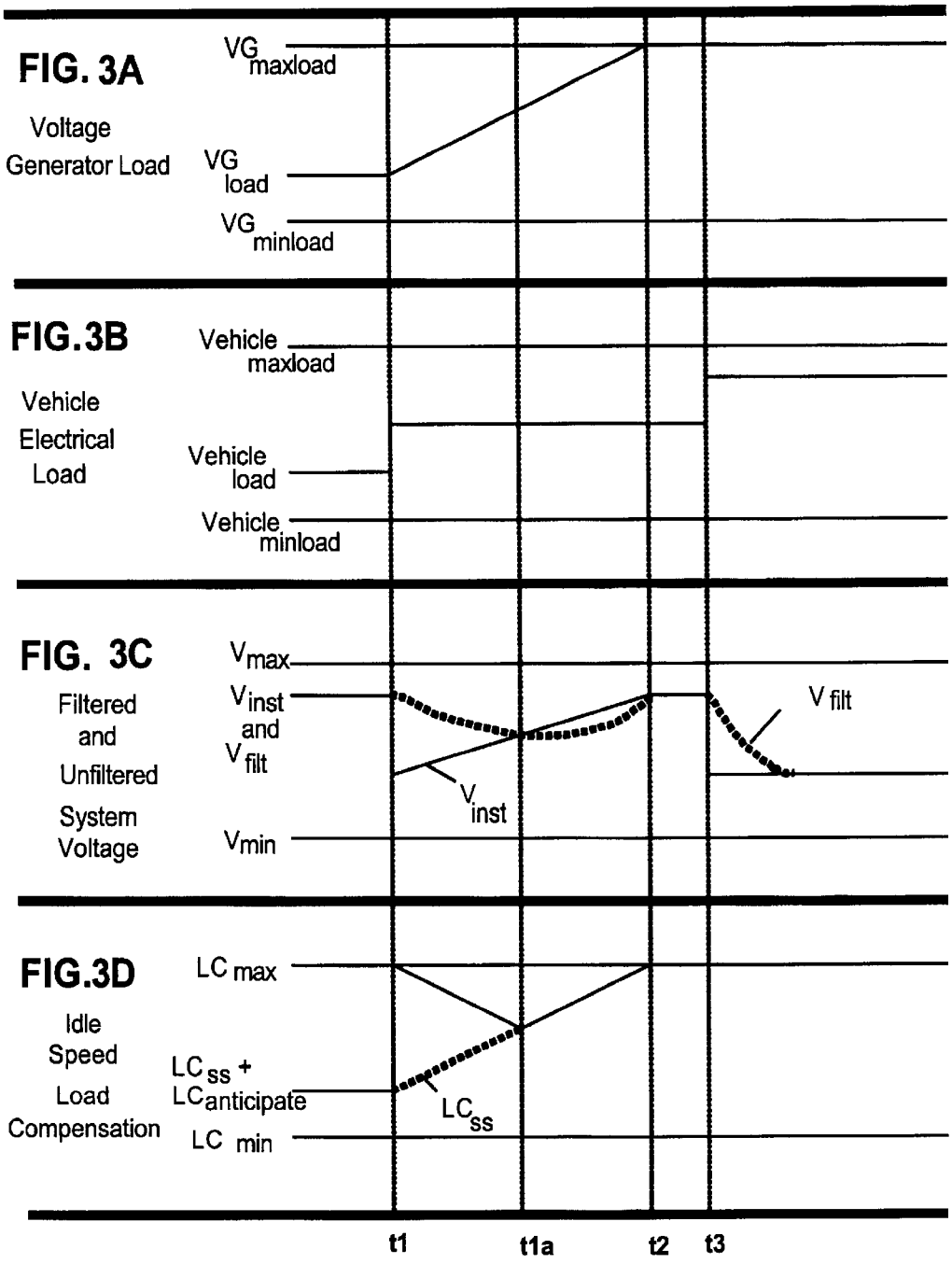
FIGS. 3A to 3D illustrate examples of time-based state diagrams for idle operation of an engine to which an idling speed control method according to the present invention is applied.

FIG. 3A illustrates an example of response characteristics of a voltage generator as described in FIG. 1 above when reacting to a mobile vehicle system's electrical power requirement. FIG. 3A includes a variable load component $VG_{load}$ and a maximum load $VG_{maxload}$. In one embodiment and referring to FIG. 1, the maximum load limit $VG_{maxload}$ is the maximum generation value as established by the manufacturer. In another embodiment and again referring to FIG. 1, $VG_{maxload}$ is the maximum generating capability due to ambient air temperature derating.

FIG. 3A further illustrates the variable load component $VG_{load}$ increasing (from time increments t1 to t2) to compensate for the increased electrical power requirements from the vehicle system. In an example, the increased electrical power requirement at time increment t1 represents a user initiating use of headlights, A/C fan, and the like. The voltage generator increases its power generation at a constant rate until either the requirement is met or the voltage generator achieves maximum output. Time increment t2 represents both the voltage generator reaching $VG_{maxload}$ and satisfying the increased electrical load which was imposed at time increment t1.

FIG. 3B simply represents the total vehicle electrical load for which the voltage generator provides power. At time increment t1, the vehicle electrical load increases quickly in response to a user applied electrical load as described for FIG. 3A above. At time increment t3, the vehicle electrical load increases further due to another electrical load being applied to the vehicle system.

FIG. 3C illustrates an example of filtered voltage $V_{filt}$ and instantaneous voltage $V_{inst}$ when reacting to increased vehicle electrical loads. $V_{inst}$ is also referred to as unfiltered ignition voltage. In one example, filtered voltage $V_{filt}$ and unfiltered voltage $V_{inst}$ may be implemented as described FIG. 1 above.

At time increment t1, unfiltered voltage $V_{inst}$ drops rapidly in response to the increased load requirement as described for FIG. 3B above. The filtered voltage $V_{filt}$ decreases at a slower rate due to the filtering effect. Referring to FIG. 2, method 250 and the time between time increments t1 and t1*a*, $V_{diff}$ is a positive value and therefore contributes to the $LC_{anticipate}$ value. The anticipatory component of the load compensation allows the engine idle speed compensation to be scheduled prior to a large increase in the voltage generator load. Since the idle speed compensation is issued prior to the load increase, any inherent delay between issuing idle compensation and the actual increase in idle torque are greatly reduced resulting in less idle speed fluctuation. Between time increments t1*a*and t2 and again referring to FIG. 2 method 250, $V_{filt}$ is less than $V_{inst}$ and therefore does not contribute to $LC_{anticipate}$. At time increment t2, the voltage generator has reached a generating output equal to the vehicle load demand and therefore the system voltage has returned to the regulation setpoint. Time increment t3 represents an additional vehicle electrical load. $V_{diff}$ is again a positive value; however, from FIG. 3A it can be seen that the voltage generator is already operating at maximum output. Therefore, referring to FIG. 2 method 230, the remaining load compensation $LC_{remaining}$ that can be scheduled is zero.

FIG. 3D illustrates an example of an idle speed control signal generated using the present invention. FIG. 3D represents, referring to FIG. 2 method 260, the summation of the load compensation for the steady state load $LC_{ss}$ and the anticipatory load $LC_{anticipate}$.

At time increment t1 and referring to FIG. 2 above, $V_{filt}$ exceeds $V_{inst}$ while the voltage generator is not operating at max load. This causes $LC_{anticipate}$ to be added to $LC_{ss}$. At time increment t1*a*, $V_{filt}$ no longer exceeds $V_{inst}$ due to the voltage generator increasing its electrical power generation. Therefore, $LC_{anticipate}$ reduces to zero and the only contribution to $LC_{sum}$ is $LC_{ss}$. However, by time increment t1*a*, the voltage generator is producing near required power levels to meet system demands and the anticipatory load compensation term is no longer required. In this embodiment, time increment t2 represents the voltage generator reaching full load and the consequent scheduling of maximum load compensation. Time increment t3 represents an additional electrical load which the voltage generator is incapable of supplying since it is already at maximum output. For this example, it is shown to indicate that additional idle compensation will not be scheduled when the voltage generator is operating at maximum output even though $V_{diff}$ is a positive value.

Figure 4:
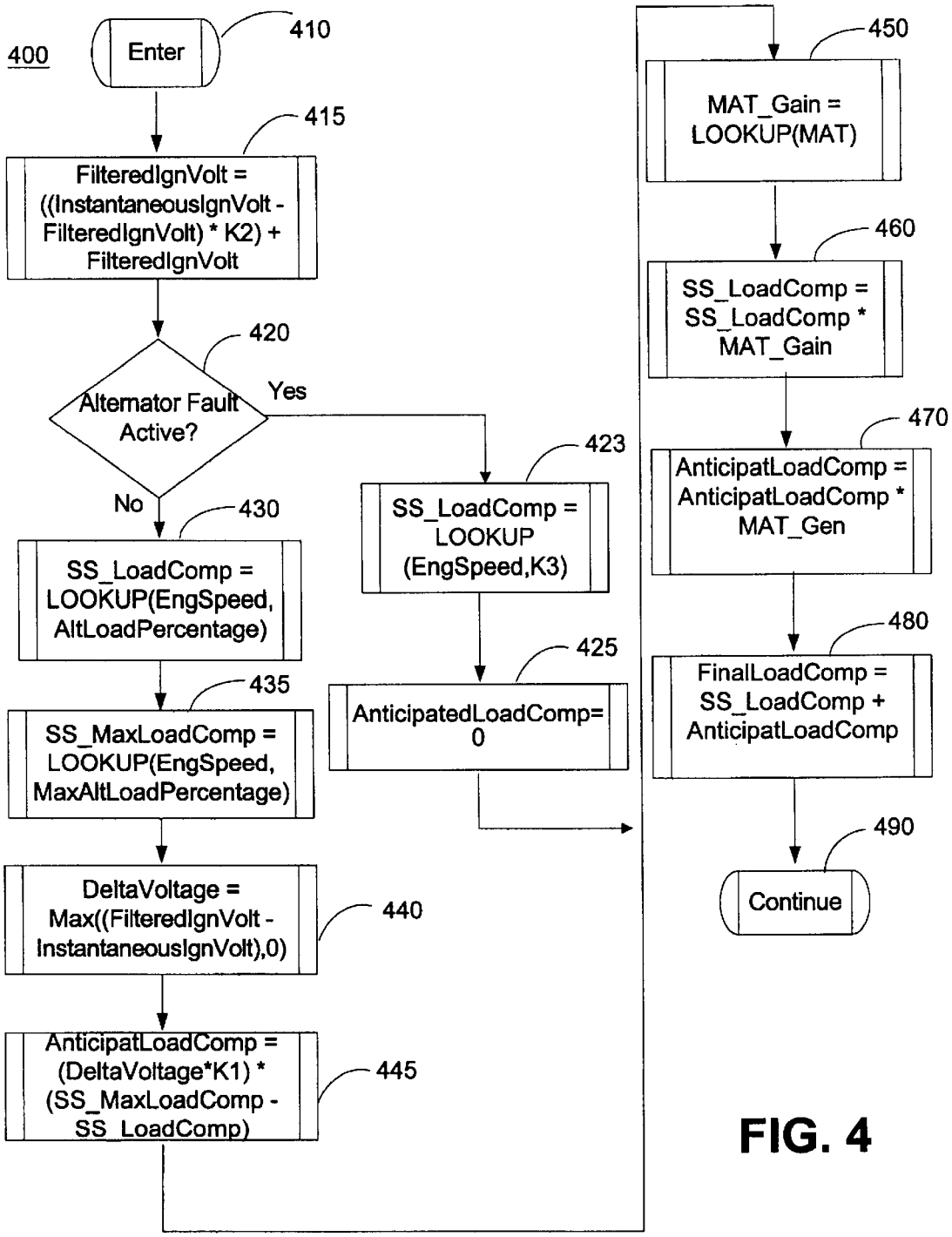
FIG. 4 is a flow diagram depicting another exemplary embodiment of code on a computer readable medium in accordance with the present invention.

FIG. 4 is a flow diagram depicting an exemplary embodiment of code on a computer readable medium in accordance with the present invention. FIG. 4 details an embodiment of a method 400 for operation an idle speed control system, in accordance with the present invention. Method 400 may utilize one or more systems detailed in FIG. 1 above and one or more portions of the method detailed in FIG. 2 above.

Method 400 begins at block 410 which is called at a periodic rate. In one embodiment, block 410 is implemented as block 210 of FIG. 2 above. The method then advances to block 415.

At block 415, the method performs FilteredIgnVolt= ((InstantaneousIgnVolt−FilteredIgnVolt)*K2)+FiltereredIgn Volt. In one embodiment, FilteredIgnVolt represents $V_{filt}$ and InstantaneousIgnVolt represents $V_{inst}$ of FIGS. 2 and 3. This pseudocode allows method 400 to assign a modified value to FilteredIgnVolt based on changes to the InstantaneousIgnVolt and some constant K2. In an example, K2 is a constant chosen such that the ignition filter rate matches the voltage generator's ramp-on rate. The method advances to decision block 420.

At decision block 420, the method determines if an alternator fault is active. In one embodiment, an alternator fault flag is set if the alternator determines that it is sending a corrupted signal data, is sending inaccurate data, is not functioning properly, and the like. If the alternator fault is not active the method advances to block 430, otherwise the method advances to block 423.

At block 423, a steady state load compensation $LC_{ss}$ value is determined utilizing a look-up table and an engine speed signal in conjunction with a default alternator load value constant K3. The method then advances to block 425.

At block 425, the anticipated load compensation value is set to zero. The method then advances to block 450.

At block 430, the method determines the steady state load compensation value $LC_{ss}$. In one embodiment, $LC_{ss}$is determined as in block 230 of FIG. 2. The method then advances to block 435. At block 435, the method determines the maximum load compensation value $LC_{max}$. In one embodiment, $LC_{max}$ is determined as in block 230 of FIG. 2. The method then advances to block 440.

At block 440, the method determines a voltage difference between filtered and instantaneous voltage. In one embodiment, the voltage difference $V_{diff}$ is determined as in block 250 of FIG. 2. The method then advances to block 445. At block 445, the method determines an anticipated load compensation value. In one embodiment, the anticipated load compensation value is determined as in block 250 of FIG. 2. The method then advances to block 450.

At block 450, the method performs MAT_Gain= LOOKUP(MAT). MAT represents the engine compartment air temp as described in FIG. 1 above. MAT_Gain, also referred to as $K_{derate}$ in block 260 of FIG. 2, represents the factor by which the voltage generator load will be reduced due to high ambient temperatures surrounding the voltage generator. The method then advances to block 460.

At block 460, the voltage generator derating factor MAT_Gain is applied to $LC_{ss}$ resulting in a revised $LC_{ss}$. The method then advances to block 470 where MAT_Gain is applied to $LC_{anticipate}$ resulting in a revised $LC_{anticipate}$. The method then advances to block 480.

At block 480, the method determines a final load compensation value referred to as $LC_{final}$ in block 270 of FIG. 2. In one embodiment, $LC_{final}$ is the summation of $LC_{anticipate}$ and $LC_{ss}$ with the derating factor $K_{derate}$ already applied. The method then advances to block 490, where it returns to wait for the next periodic time-base event which will cause method 400 to be re-executed.

The above-described methods and implementation for idle speed control of an internal combustion engine are example methods and implementations. These methods and implementations illustrate one possible approach for voltage generator load modeling that provides stability within a dynamic electrical generation system during idle operations. The actual implementation may vary from the method discussed. Moreover, various other improvements and modifications to this invention may occur to those skilled in the art, and those improvements and modifications will fall within the scope of this invention as set forth in the claims below.

The present invention may be embodied in other specific forms without departing from its spirit or essential characteristics. The described embodiments are to be considered in all respects only as illustrative and not restrictive.

What is claimed is:

1. A system for controlling idle speed for an internal combustion engine comprising:

means for monitoring a plurality of vehicle system signal inputs;

means for determining a baseline load control signal based on the vehicle system signal inputs;

means for determining a maximum load control signal based on the vehicle system signal inputs;

means for determining an anticipated load control signal based on the vehicle system signal inputs;

means for determining an idle speed control signal based on the baseline control signal and the anticipated control signal;

means for modifying the idle speed control signal based on vehicle system signal inputs; and means for controlling the idle speed based on the modified idle speed control signal.

2. A computer readable medium storing a computer program comprising:

computer readable code for monitoring a plurality of vehicle system signal inputs;

computer readable code for determining a baseline load control signal based on the vehicle system signal inputs;

computer readable code for determining a maximum load control signal based on the vehicle system signal inputs;

computer readable code for determining an anticipated load control signal based on the vehicle system signal inputs;

computer readable code for determining an idle speed control signal based on the baseline control signal and the anticipated control signal;

computer readable code for modifying the idle speed control signal based on vehicle system signal inputs; and computer readable code for controlling the idle speed based on the modified idle speed control signal.

3. The computer readable medium of claim 2 wherein the vehicle system signal inputs are selected from a group consisting of: a voltage generator load signal input, a vehicle system voltage signal input, an engine compartment air temperature signal, and an engine speed signal input.

4. The computer readable medium of claim 3 wherein the voltage generator load signal input is selected from a group consisting of: a discrete duty cycle signal and a serially transmitted signal.

5. The computer readable medium of claim 3 wherein the engine speed signal input is selected from a group consisting of a crank angle signal and a serially transmitted signal.

6. The computer readable medium of claim 3 wherein the engine compartment air temperature signal input is selected from a group consisting of: a direct analog input from a temperature measurement device, a serially transmitted signal, and a modeled value based on another available temperature input.

7. The computer readable medium of claim 2 wherein the computer readable code for monitoring the plurality of vehicle system signal inputs comprises computer readable code for monitoring unfiltered vehicle system voltage.

8. The computer readable medium of claim 2 wherein determining the baseline load control signal comprises:

computer readable code for comparing the vehicle system signal inputs to a database; and computer readable code for determining the baseline control signal value based on the comparison.

9. The computer readable medium of claim 8 wherein the database comprises a lookup table comprising a baseline load control signal value for each combination of engine speed signal and voltage generator load signal.

10. The computer readable medium of claim 2 wherein determining the maximum load control signal comprises:

computer readable code for comparing the vehicle system signal inputs to a database; and computer readable code for determining the maximum load control signal based on the comparison.

11. The computer readable medium of claim 10 wherein the database comprises a lookup table comprising a maximum load control signal value for each combination of engine speed signal and maximum voltage generator load signal.

12. The computer readable medium of claim 2 wherein determining the control signal comprises:

computer readable code for creating and maintaining a filtered vehicle system voltage;

computer readable code for subtracting the unfiltered vehicle system voltage from the filtered system voltage and limiting the minimum result to zero;

computer readable code for multiplying the result of the subtraction by a constant and limiting the product to one;

computer readable code for multiplying the product by the greater of zero or the result of subtracting the baseline load control signal from the maximum load control signal; and computer readable code for assigning the result to the anticipated load control signal.

13. The computer readable medium of claim 2 wherein computer readable code for determining the idle speed control signal comprises computer readable code for implementing a summation of the baseline load signal and the anticipated load control signal.

14. The computer readable medium of claim 13 wherein the computer readable code for idle speed control signal determination further comprises:

computer readable code for comparing the vehicle system signal inputs to a database;

computer readable code for determining a derating factor based on the comparison;

computer readable code for modifying the idle speed control signal based on the derating factor; and computer readable code for assigning the modified idle speed control signal as the idle speed control signal.

15. A method for controlling idle speed for an internal combustion engine, the method comprising:

monitoring a plurality of vehicle system signal inputs;

determining a baseline load control signal based on the vehicle system signal inputs;

determining a maximum load control signal based on the vehicle system signal inputs;

determining an anticipated load control signal based on the vehicle system signal inputs;

determining an idle speed control signal based on the baseline control signal and the anticipated control signal;

modifying the idle speed control signal based on vehicle system signal inputs; and controlling the idle speed based on the modified idle speed control signal.

16. The method of claim 15 wherein the vehicle system signal inputs are selected from a group consisting of: a voltage generator load signal input, a vehicle system voltage signal input, an engine compartment air temperature signal, and an engine speed signal input.

17. The method of claim 16 wherein the voltage generator load signal input is selected from a group consisting of a discrete duty cycle signal and a serially transmitted signal.

18. The method of claim 16 wherein the method of monitoring vehicle system signal inputs comprises monitoring unfiltered vehicle system voltage.

19. The method of claim 16 wherein the engine speed signal input is selected from a group consisting of a crank angle signal and a serially transmitted signal.

20. The method of claim 16 wherein the engine compartment air temperature signal input is selected from a group consisting of: a direct analog input from a temperature measurement device, a serially transmitted signal, and a modeled value based on another available temperature input.

21. The method of claim 15 wherein determining the baseline control signal comprises:

comparing the vehicle system signal inputs to a database; and determining the baseline control signal value based on the comparison.

22. The method of claim 21 wherein the database comprises a lookup table comprising a baseline control signal value for each combination of engine speed signal and voltage generator load signal.

23. The method of claim 15 wherein determining the maximum load control signal comprises:

comparing the vehicle system signal inputs to a database; and determining the maximum load control signal based on the comparison.

24. The method of claim 23 wherein the database comprises a lookup table comprising a maximum load control signal value for each combination of engine speed signal and maximum voltage generator load signal.

25. The method of claim 15 determining the anticipated load control signal comprises:

creating and maintaining a filtered vehicle system voltage;

subtracting the unfiltered vehicle system voltage from the filtered system voltage and limiting the minimum result to zero;

multiplying the result of the subtraction by a constant and limiting the product to one;

multiplying the product by the greater of zero or the result of subtracting the baseline load control signal from the maximum load control signal; and assigning the result to the anticipated load control signal.

26. The method of claim 15 determining the idle speed control signal comprises a summation of the baseline load signal and the anticipated load control signal.

27. The method of claim 26 wherein the idle speed control signal determination further comprises:

comparing the vehicle system signal inputs to a database;

determining a derating factor based on the comparison;

modifying the idle speed control signal based on the derating factor; and assigning the modified idle speed control signal as the idle speed control signal.

* * * * *